US009670628B2

(12) United States Patent
Bletscher et al.

(10) Patent No.: US 9,670,628 B2
(45) Date of Patent: Jun. 6, 2017

(54) GROUND PREPARATION MACHINE, IN PARTICULAR A COMPACTOR

(71) Applicant: Hamm AG, Tirschenreuth (DE)

(72) Inventors: Thomas Bletscher, Bechtsried (DE); Gerd Koestler, Tirschenreuth (DE)

(73) Assignee: Hamm AG, Tirschenreuth (DE)

( * ) Notice: Subject to any disclaimer, the term of this patent is extended or adjusted under 35 U.S.C. 154(b) by 0 days.

(21) Appl. No.: 14/971,238

(22) Filed: Dec. 16, 2015

(65) Prior Publication Data

US 2016/0177518 A1 Jun. 23, 2016

(30) Foreign Application Priority Data

Dec. 18, 2014 (DE) ..... 10 2014 118 988

(51) Int. Cl.
*E01C 19/23* (2006.01)
*E02D 3/02* (2006.01)
*E02D 3/026* (2006.01)

(52) U.S. Cl.
CPC ..... *E01C 19/238* (2013.01); *E02D 3/026* (2013.01)

(58) Field of Classification Search
CPC ..... E01C 19/26; E01C 19/22; E01C 19/23; E01C 19/238; E02D 3/026; B60S 3/042; B60S 1/68
See application file for complete search history.

(56) References Cited

U.S. PATENT DOCUMENTS 1,065,188 A * 6/1913 Thompson ..... B60S 1/68 280/855
5,188,394 A * 2/1993 Roche ..... B60S 1/68 172/606
5,360,288 A * 11/1994 O'Neill ..... E02D 3/026 37/452
5,511,901 A * 4/1996 Yates ..... E01C 19/236 404/124
5,988,940 A * 11/1999 Johansson ..... E01C 19/238 15/256.51
6,217,255 B1 4/2001 Knell et al.
(Continued)

FOREIGN PATENT DOCUMENTS

| | | |
|---|---|---|
| DE | 1 634 686 | 9/1970 |
| DE | 1634686 | 9/1970 |
| DE | 19539542 | 5/1996 |

OTHER PUBLICATIONS

Search Report of EP Application No. 15199707.9 dated Apr. 25, 2016, 6 pages.
German Search Report dated Oct. 16, 2015.

*Primary Examiner* — Abigail A Risic
(74) *Attorney, Agent, or Firm* — Rankin, Hill & Clark LLP

(57) ABSTRACT

A ground preparation machine, in particular a compactor, comprises at least one roller (16) rotatable around an axis of rotation of the roller (A) and, attached to the at least one roller (16), at least one scraper device (36, 38) for scraping off material adhering to the outer peripheral region (26) of the roller (16), wherein the scraper device (36, 38) comprises a scraper bar (40) extending along the roller (16), the scraper bar (40) being designed to provide a first scraper region (58) for scraping off material from a roller having an essentially untextured outer peripheral region (26) and to provide a second scraper region (66) for scraping off material from a roller having a textured outer peripheral region (26).

18 Claims, 9 Drawing Sheets

(56) References Cited

U.S. PATENT DOCUMENTS

| | | | | |
|---|---|---|---|---|
| 8,721,217 | B2 * | 5/2014 | Bornemann | E01C 19/238 15/256.51 |
| 9,033,613 | B2 * | 5/2015 | Dykhnich | E02D 3/026 404/121 |
| 2005/0117971 | A1 * | 6/2005 | Berg | E02D 3/026 404/129 |
| 2013/0108367 | A1 * | 5/2013 | Bornemann | E01C 19/238 404/129 |
| 2015/0110557 | A1 * | 4/2015 | Dykhnich | E02D 3/026 404/121 |

* cited by examiner

Fig. 6
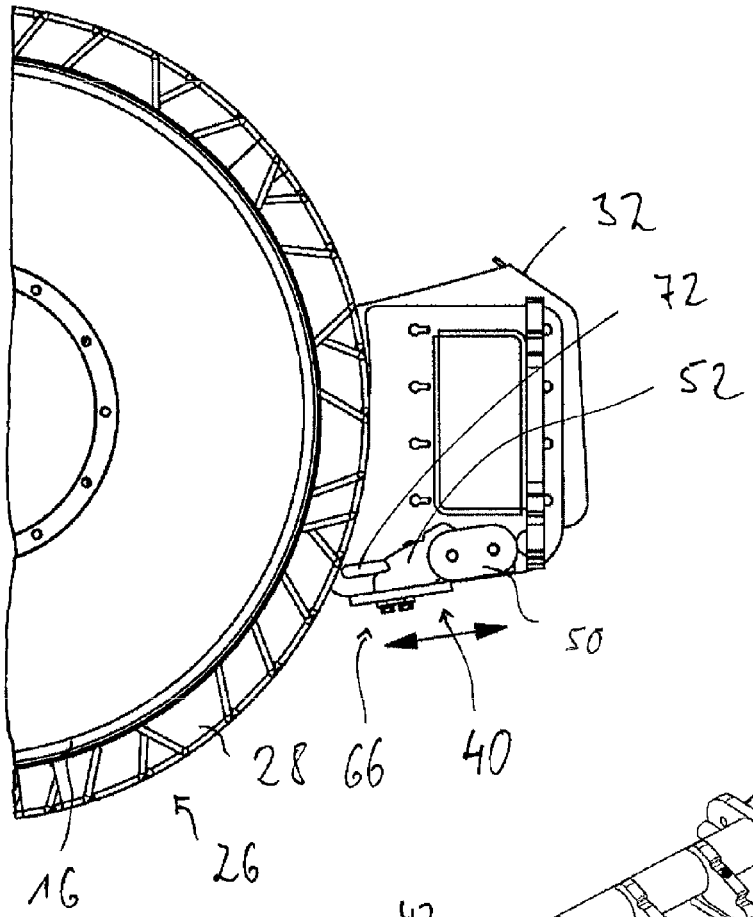
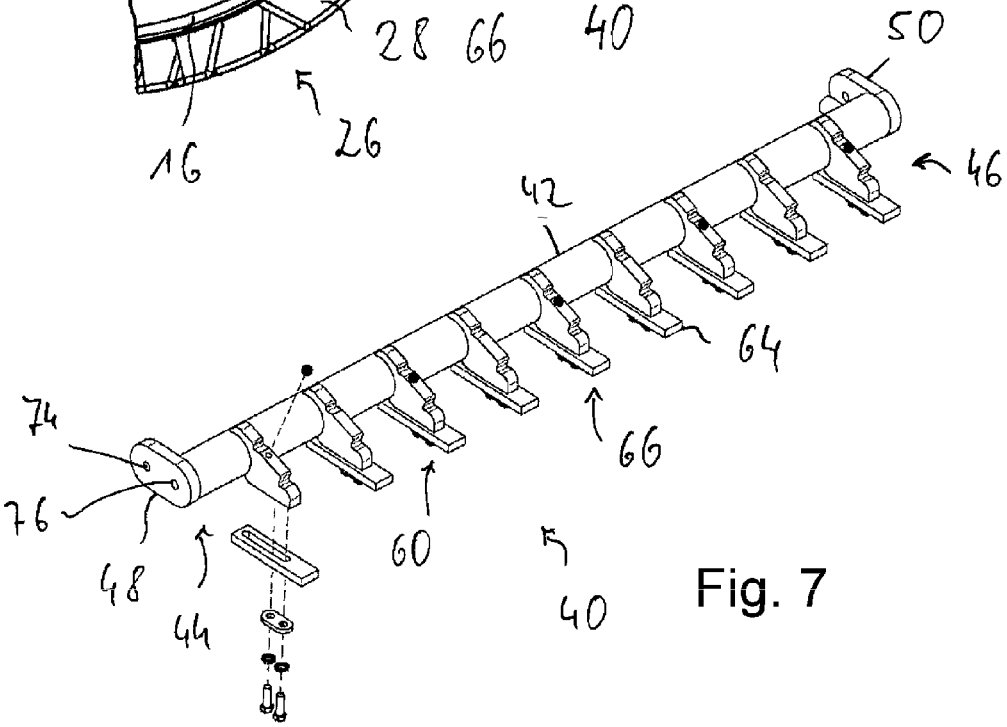
Fig. 7

GROUND PREPARATION MACHINE, IN PARTICULAR A COMPACTOR

The present invention relates to a ground preparation machine, such as compactor, comprising at least one roller rotatable around a roller axis of rotation and, attached to at least one roller, a roller scraper device for scraping off material that adheres to the outer peripheral region of the roller.

During ground preparation or compaction operations, there is always the risk, depending on the material to be prepared or compacted, that such material will adhere to the outer peripheral region of the roller. In particular when asphalt is compacted using a roller having an essentially untextured or smooth outer peripheral region, there is a tendency for asphalt material to adhere to the outer peripheral region or to the essentially smooth outer circumferential surface of the roller. Also, when soil is prepared or compacted with a roller that has a texture on its outer peripheral region, such as one provided with a plurality of padfeet or the like, there is the tendency for material, in particular soil, clay or the like, to accumulate and adhere between the texturing elements, such as the padfeet.

In order to remove such adhering material from the outer peripheral region of a roller, a known solution is to provide roller scraper devices that are generally configured along the compactor roller and have a scraper region, such as a scraper edge, extending close to the outer peripheral region of the roller. If a roller having a textured surface is used or a roller is refitted in such a way that it has a textured outer peripheral region, for example, by being clad with padfeet, then a scraper device designed for an untextured roller must generally be removed and replaced with a scraper device designed for a textured roller. This operation is costly in terms of time and money.

A ground preparation machine having two rollers arranged laterally spaced apart at the front end of the vehicle and two at the rear end of the vehicle is known from U.S. Pat. No. 6,217,255 B1. The rollers are textured on their outer peripheral region and have annular regions projecting radially outward and recessed areas between them. Attached to each of these rollers is a scraper device having a plurality of tooth-like projecting scraper members that are movable on each support toward or away from the outer peripheral region of the attached roller. By means of a hydraulically operated piston/cylinder unit, tooth-like scraper members attached to each other in pairs can be moved as appropriate into or out of the gaps formed between two rings to detach accumulated material from an attached roller when the tooth-like scraper members are positioned to engage in the gaps.

DE-A 1 634 686 discloses a road roller having a convertible roller drum. A plurality of padfeet or the like projecting radially outward is provided on the outer circumference of the roller to texture the outer peripheral region. To provide a roller with an essentially untextured outer peripheral region, the roller can be encased by shell-like sheathing elements so that the padfeet can be concealed beneath a roller shell furnished by the sheathing elements.

The object of the present invention is to provide a ground preparation machine, in particular a compactor, which in a simple way enables a scraper device to be adapted to an operation with a roller having an untextured outer peripheral region as well as to a roller having a textured outer peripheral region.

This object is achieved according to the invention by a ground preparation machine, in particular a compactor, comprising:

at least one roller rotatable around a roller axis of rotation, a scraper device for scraping off material adhering to the outer peripheral region of the roller attached to at least one roller, wherein the scraper device comprises a scraper bar extending along the roller, the scraper bar being designed to provide a first scraper region for scraping material from a roller having an essentially untextured outer peripheral region and being designed to provide a second scraper region for scraping material from a roller having a textured outer peripheral region.

In the design according to the invention, it is therefore provided that one and the same scraper device can be used in conjunction with rollers having different configurations of the outer peripheral region. In some cases, adaptive measures may be required inside the scraper device itself. It is not necessary to completely replace a scraper device provided for an untextured roller with a scraper device for a roller having a textured outer peripheral region.

To achieve effective scraping interaction with the design according to the invention, the invention proposes that the scraper bar be extended along the roller preferably essentially parallel to the roller axis of rotation.

In order to be able to adapt the scraper device of the ground preparation machine for interaction with differently designed rollers, the invention proposes that the scraper bar be movable between:

a first operating position, where, in the first operating position, the first scraper region is in scraping interaction with the compactor roller, and/or a second operating position, where, in the second operating position, the second scraper region is in scraping interaction with the compactor roller, and an installation/removal position where, in the installation/removal position, the scraper bar is positioned for installation or removal and/or for adjustment of at least one first scraper member of the first scraper region and/or of at least one second scraper member of the second scraper region.

To be able to reach these various positions easily, the invention proposes that the scraper bar swivel around an axis of movement essentially parallel to the roller axis of rotation and/or be displaceable toward and away from the outer peripheral region of the roller.

To attach the scraper bar on a machine frame to permit swivel movement or displacement movement, the invention proposes that the scraper bar be solidly attached at its two end regions to a machine frame in the first operating position and/or in the second operating position and that it be swivel-mounted on the machine frame for movement into and out of the installation/removal position.

To this end, a slot guide may be provided that, for example, is attached to each end region of the scraper bar on the machine frame, the scraper bar being solidly connected or connectable to the machine frame via at least one fastener, preferably a plurality of fasteners, passing through the slot guide in the first and/or second operating position and being able to swivel with respect to the machine frame by means of a fastener passing through the slot guide.

In order to configure scraper devices for scraping interaction with differently designed rollers having the structure according to the invention, the invention proposes that the scraper bar comprise a first mounting region for attaching at least one first scraper member of the first scraper region and a second mounting region for attaching at least one second scraper member of the second scraper region.

This ability to install or remove different scraper members may be achieved in a simple way by virtue of the scraper bar comprising a longitudinally extending bar body and a plurality of scraper member supports on the bar body that provide the first mounting region and the second mounting region.

In an alternative embodiment, the scraper bar can comprise a longitudinally extending bar body comprising at least one first mounting plate providing the first mounting region and at least one second mounting plate providing the second mounting region. The scraper members attached to the different scraper regions, or the support elements supporting them, can be fixed on the preferably essentially flat surfaces of these mounting plates.

To provide scraping interaction with rollers having an untextured outer peripheral region or rollers having a textured outer peripheral region, the invention proposes that the first scraper region comprise at least one scraper member providing a scraper edge running essentially without interruption along the roller axis of rotation and/or that the second scraper region comprise a plurality of projecting tooth-like second scraper members arranged along the roller axis of rotation spaced apart from each other.

In order to obtain the scraping interaction with a roller using the differently configured scraper members in the positions discussed above, the invention further proposes that, when a scraper bar is positioned in the first operating position, the at least one scraper member of the first scraper region be in scraping interaction with the outer peripheral region of the compactor roller and the second scraper members of the second scraper region not be in scraping interaction with the outer peripheral region of the compactor roller but nevertheless be supported on the scraper bar and that, when the scraper bar is positioned in the second operating position, a first scraper member of the first scraper region be removed from the scraper bar and the second scraper members of the second scraper region be in scraping interaction with the outer peripheral region of the roller.

For simple actuation of the scraper bar, such as swiveling or displacement between the different positions, the invention proposes that at least one actuating mechanism be attached or attachable to the scraper bar for swiveling and/or displacing and/or holding the scraper bar.

In order to optimally use the scraper device, or any scraper device, of a ground preparation machine designed according to the invention for scraping material from the outer peripheral region of a roller, the invention proposes that at least one scraper region comprise at least one scraper member that can be brought into scraping interaction with the roller, wherein at least one, preferably each, scraper member, of at least one scraper region is angled relative to a radial line perpendicular to the roller axis of rotation and is inclined in the rotational direction of the roller, and/or at least one, preferably each, scraper member of at least one scraper region is angled relative to the radial line and is inclined counter to the rotational direction of the roller.

In this connection, it is noted that in the context of the present invention the rotational direction used for the definition of the inclination is the rotational direction that the roller has when the ground preparation machine is in motion primarily during ground preparation, for example driving forward. This does not exclude the possibility of other operating states occurring in which the ground preparation machine is moving in the opposite direction and, thus, the roller is turning in the opposite direction around the roller axis of rotation.

In an embodiment that is structurally especially easy to realize and also easy to manage, the invention proposes that a least one scraper member of the first scraper region and at least one scraper member of the second scraper region be inclined in the same direction, preferably in the rotational direction of the roller.

For positioning especially optimized for the scraping action of the first scraper region, the invention proposes that at least one scraper member of the first scraper region be inclined in a first direction, preferably counter to the rotational direction, and at least one scraper member of the second scraper region be inclined in a second direction, preferably in the rotational direction.

In order to remove material from the area of the scraper device that has been detached from an outer peripheral region of a roller, the invention further proposes that a diverting device for diverting material detached from the roller by the scraper member away from the roller be attached to at least one scraper member that is preferably inclined counter to the rotational direction of the roller.

For the scraper members not needed during the operation of the scraper device, at least one storage mounting area may be provided for detachably mounting at least one scraper member not installed on the scraper bar, preferably on a machine frame rotatably carrying the roller.

The present invention further relates to a method for operating a ground preparation machine, in particular a compactor, which is constructed just as previously described or which is designed with at least one scraper device constructed just as previously described attached to at least one roller. In this method, if the ground preparation machine is operated using a roller having an essentially untextured outer peripheral region, at least one scraper device attached to this roller is configured and positioned in such a way that the scraper bar with its first scraper region is in scraping interaction with the outer peripheral region of the roller, and, if the ground preparation machine is operated using a roller having a textured outer peripheral region, at least one scraper device attached to this roller is configured and positioned in such a way that its scraper bar with its second scraper region is in scraping interaction with the outer peripheral region of the compactor roller.

In this context, it may be provided according to the invention that for operation using a roller having a textured outer peripheral region at least one first scraper member of the first scraper region is removed from the scraper bar when the scraper bar is positioned in the installation/removal position, and then the scraper bar is positioned in its second operating position via a swiveling and/or displacement movement.

The present invention is described in detail below with reference to the accompanying figures. In the drawings:

FIG. 6 shows a view corresponding to FIG. 4 of a roller having a textured outer peripheral region and a scraper bar being displaced toward a second operating position;

FIG. 7 shows a partial exploded view of a scraper bar having components essentially providing a second scraper region;

Figure 10:
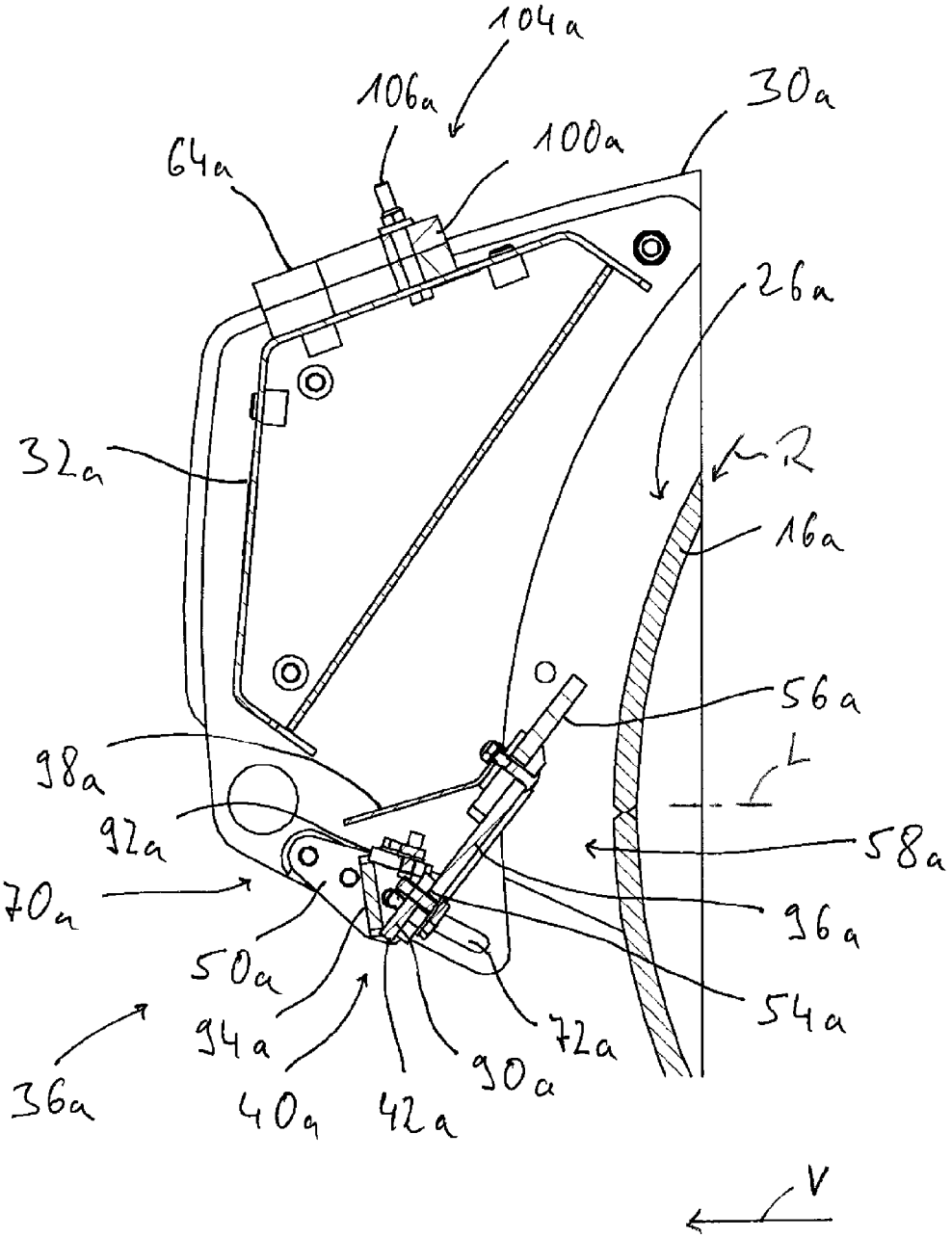
Figure 11:
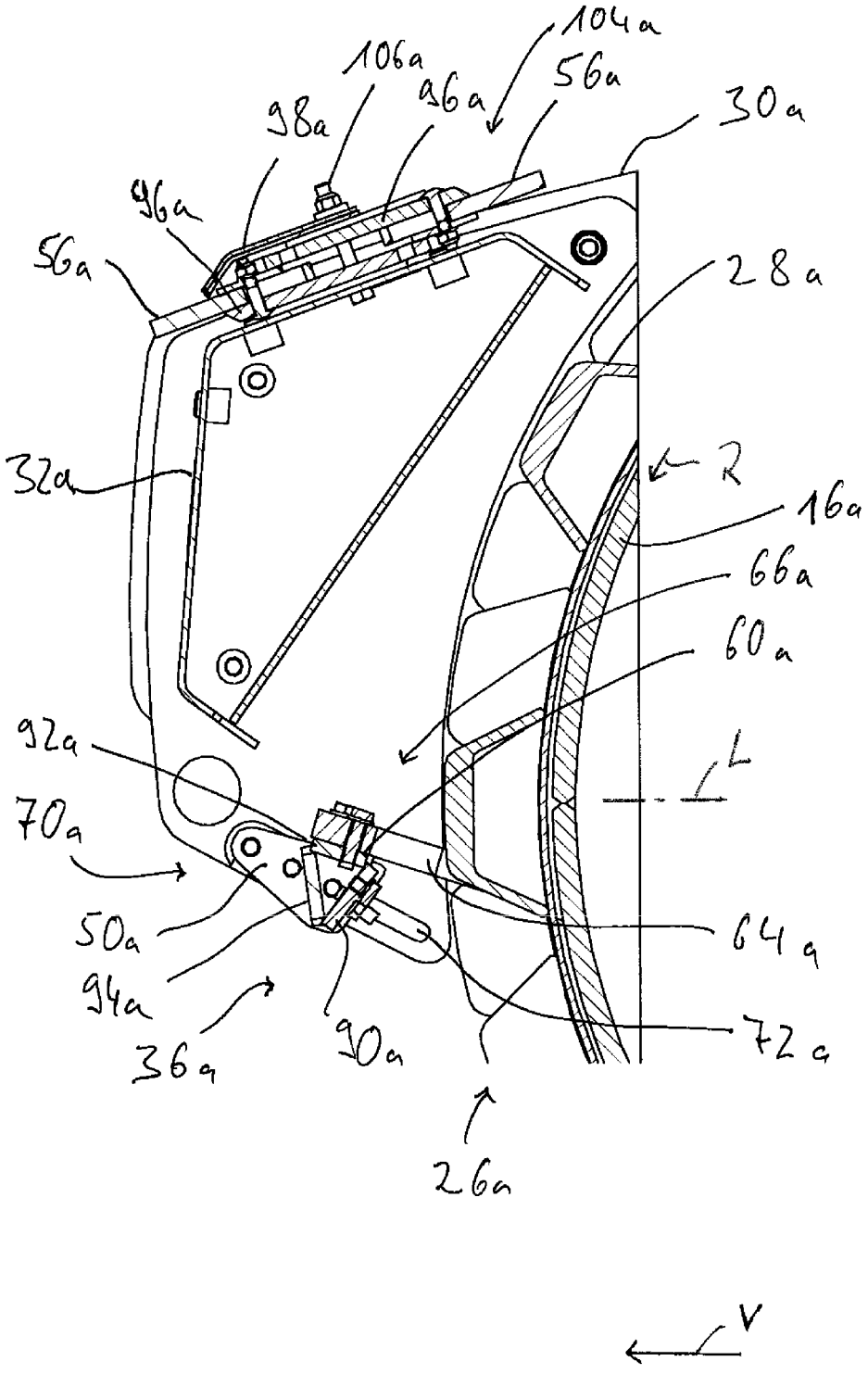

FIG. 10. Shows a sectional view of the ground preparation machine illustrated in FIG. 8 having a first scraper region prepared for operation;

FIG. 11 shows a view corresponding to FIG. 10 having a second scraper region prepared for operation.

Figure 1:
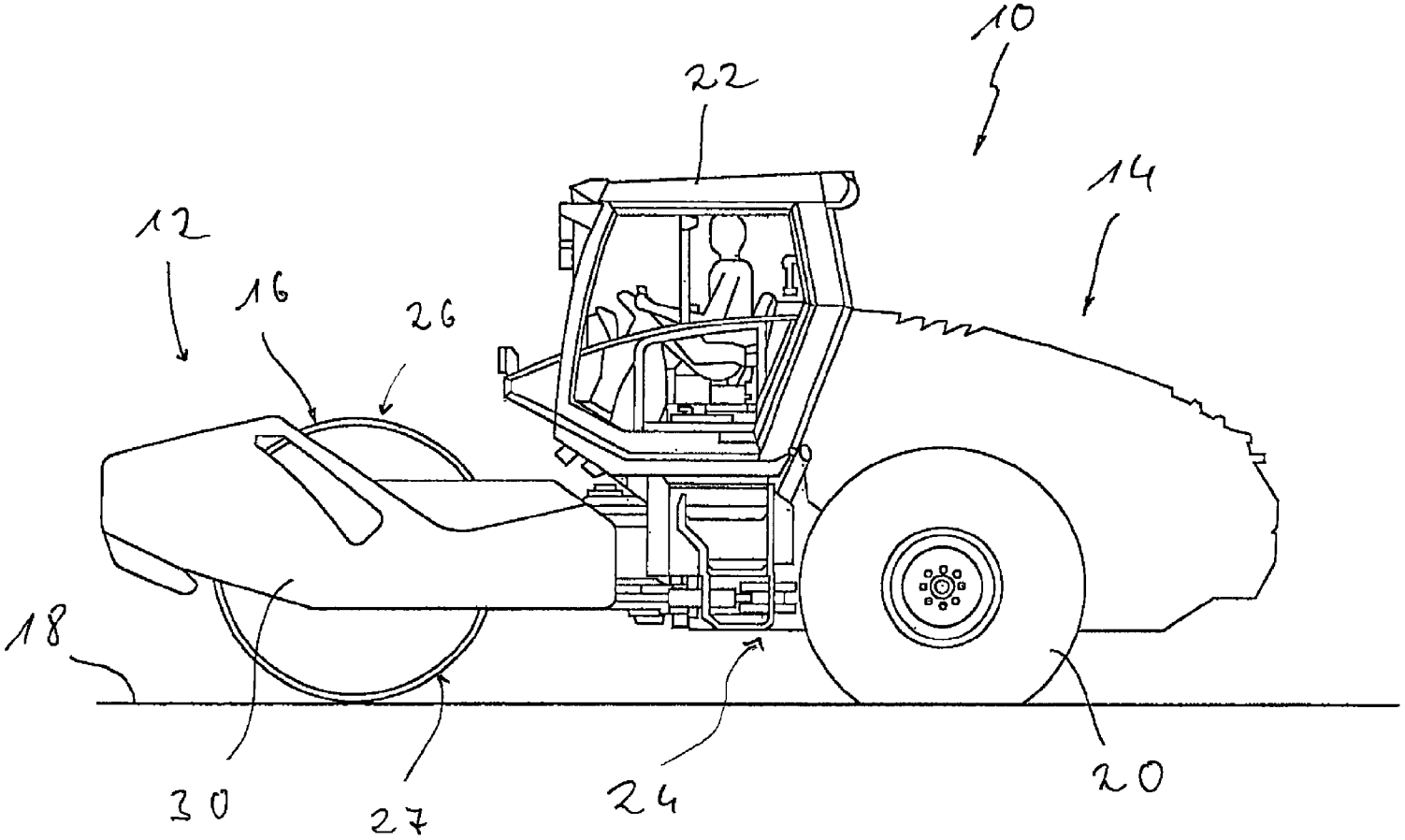
FIG. 1 shows a side view of a ground preparation machine in the form of a compactor with a roller having an essentially untextured outer peripheral region.

In FIG. 1, a ground preparation machine 10 designed as a compactor is shown in side view. The ground preparation machine 10 comprises a vehicle front end 12 and a vehicle rear end 14. At the vehicle front end 12, a roller 16 for processing, in this case for compaction of subsoil 18, is carried rotatably around a roller axis of rotation. Drive wheels 20 and a driver's cab 22 are provided on the rear end of the vehicle 14. The drive wheels 20 are drivable by a drive unit that is also provided at the rear end of the vehicle 14. Unbalanced masses provided in the roller 16 where required in particular cases, for example for generation of an oscillation motion and/or a vibration motion of the roller 16, may also be driven by the drive unit 24 or by the power provided by the drive unit 24.

Scraper devices can be attached to such a roller 16 to scrape off material, for example soil, asphalt material or the like at the outer peripheral region 26 of roller 16, in particular a surface 27 that in this case is designed to be untextured, that is, smooth. The structure and functionality of scraper devices of this kind are described in detail below in reference to FIGS. 2 to 7.

Figure 2:
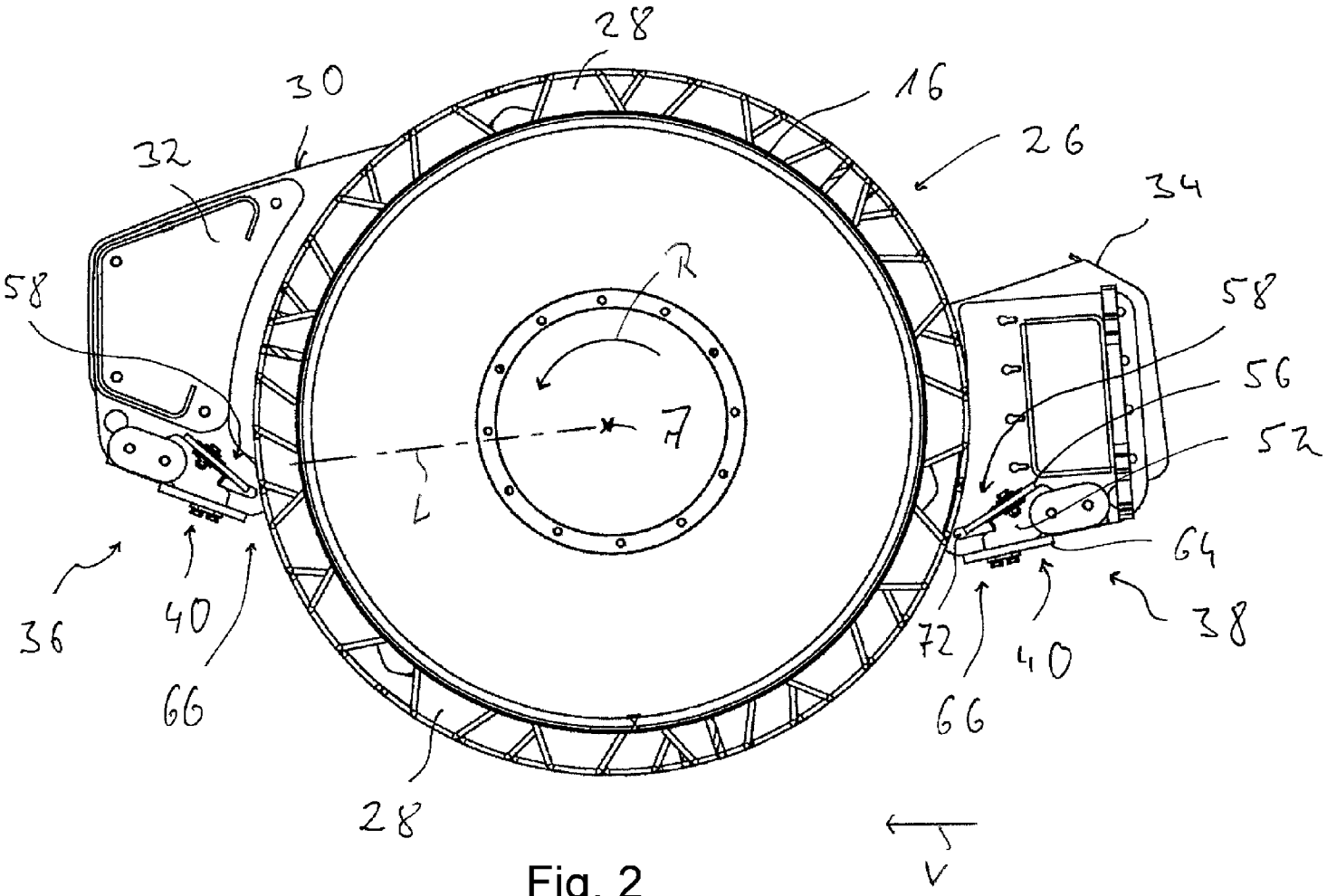
FIG. 2 shows a side view of a roller having a textured outer peripheral region and scraper devices attached thereto.

FIG. 2 shows a side view of a roller 16 designed with a textured outer peripheral region 26. For example, the textured outer peripheral region 26 may be provided by a plurality of padfeet 28 arranged on the outer circumference of roller 16. These may be arranged in succession in the circumferential direction and in a plurality of rows in the direction of the roller axis of rotation A so that in each case an intermediate space is formed between successive rows or rings of padfeet 28 in the direction of the roller axis of rotation A.

It should be noted here that a roller 16 may always be constructed with padfeet 28 of this kind, thus having a textured outer peripheral region 26. Alternatively, a roller 16 may also be constructed with the untextured outer peripheral region 26 shown in FIG. 1. If a roller 16 of this type is to be used for compacting soil, for example, it can be sheathed with a plurality of shell-like cladding elements on which padfeet or other processing elements are arranged, thereby texturing the outer peripheral region 26.

FIG. 2 also shows the machine frame 30 of the front end of the vehicle 12 rotatably supporting roller 16. Two scraper devices 36, 38 attached to roller 16 are provided on cross-members 32, 34 of machine frame 30 that extend essentially transverse to a direction of movement of the ground preparation machine 10 or essentially in the direction of the axis of rotation of the roller A. Scraper device 36 is disposed relative to a forward direction of movement of the ground preparation machine 10 in front of roller 16, while scraper device 38 is disposed behind roller 16. Scraper devices 36 and 38 are of the same design, so that their structure and functionality are described below in detail in reference to scraper device 36. These explanations also apply in like manner to scraper device 38. It should also be noted that a roller 16 could of course also be provided at the rear end of the vehicle 14 in place of the drive wheels 20, that is, the ground preparation machine 10 could be designed with two rollers 16. One or two scraper devices 36 or 38 may then be attached to each of these rollers.

The scraper device 36 comprises a scraper bar generally labeled 40. This scraper bar 40 is positioned in such a way that it extends along roller 16 essentially parallel to the roller axis of rotation A and may thereby include its entire axial length in the scraping operation.

The scraper bar 40 comprises a tubular bar body 42 that extends longitudinally. Plate-like mounting elements 48, 50 are secured at its two end regions 44, 46 by welding, for example. Furthermore, respective scraper member supports 52 extend from the bar body 42 at essentially equal spacing from each other. The scraper member supports 52 provide a first mounting region 54 on which a first scraper member 56 of a first scraper region 58, designed in this case in the shape of a uniform plate or blade, can be secured, for example by bolting. In this context, the bolted connection may be made through the corresponding slot 60 in the first scraper member 56 so that it may be disposed transverse to the longitudinally extending direction of the bar body 42 in various displacement positions and then tightened. The scraper member supports 52 further provide a second mounting region 60 on a side oriented opposite to the first mounting region 54. On the second mounting region 60, plate-like or tine-like second scraper members 64 of a second scraper region 66 may be secured to the scraper member supports 52, for example by bolting. The second scraper members 64 may also be designed with a slot 68 through which they are secured using two bolts, for example, so that the second scraper members 64 may also be displaced transverse to the longitudinally extending direction of the bar body 42 or may be secured in different positions. As shown in FIG. 7, the second scraper members 64 project in tooth-like manner, with reciprocal spacing in the longitudinal direction of the scraper bar 40, Counter mounting regions 70 may be provided on machine frame 30, for example on cross-member 32, attached to the two plate-like mounting elements 48, 50. Each counter mounting region 70 may comprise a slot 72 through which at least two fasteners, for example mounting bolts, may be screwed into corresponding threaded holes 74, 76 of the mounting elements 48, 50. If two bolts or fasteners of this type are screwed into an attached mounting element 48 or 50 while passing through a respective slot 72, the scraper bar 40 is essentially secured against swiveling or tilting but is displaceable in the longitudinal direction of a corresponding slot 72 toward or away from the outer peripheral region 26 of the roller 16. In each of these displacement positions, the scraper bar 40 may be locked by bolting it down. If only one of the mounting bolts is guided through the corresponding slot 72 and screwed into an attached mounting element 48, 50, the scraper bar 48 may be swiveled with or around this fastener within the respective slot 72 and, where applicable, also simultaneously displaced.

Figure 4:
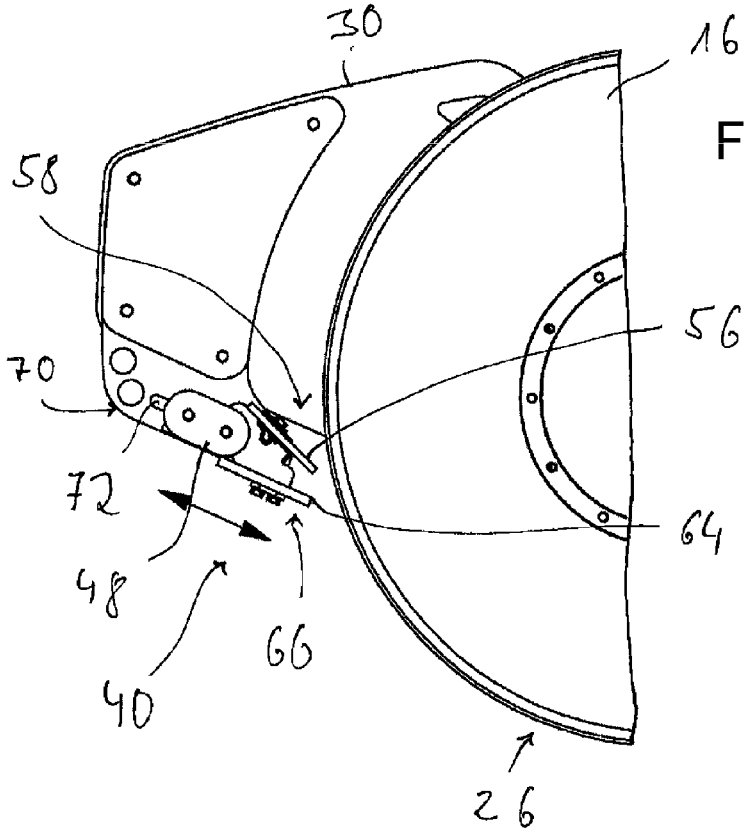
FIG. 4 shows a view corresponding to FIG. 3 with a scraper bar of a scraper device being displaced toward a first operating position.
Figure 5:
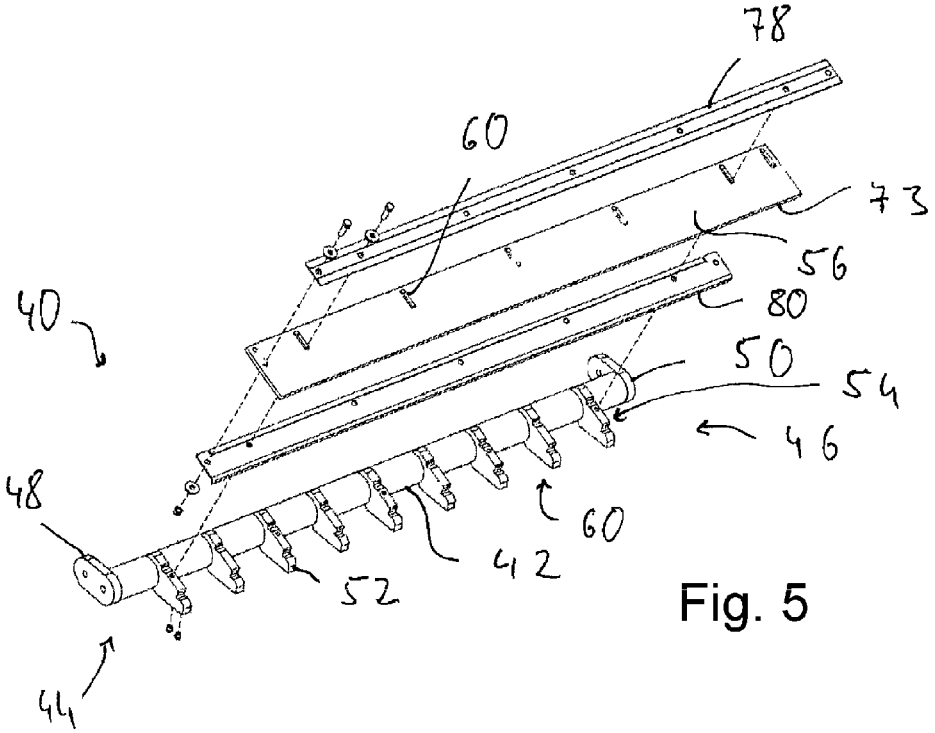
FIG. 5 shows an exploded view of a scraper bar having the components essentially providing a first scraper region.

Due to the above-described capability of the scraper bar 40 to be mounted on the machine frame 30, it becomes possible to place the scraper bar 40 or its scraper regions 58, 66, and the scraper members 56 and/or 64 respectively provided or to be provided there, in different positions. In this context, it should initially be assumed that in the delivered condition, that is, when it is new, the ground preparation machine 10 is designed just as shown in FIG. 2. The respective scraper bar (40) of the scraper devices (36, 38) is configured in such a way that both the first scraper member 56 and the second scraper members 64 are attached to the two mounting regions 54, 60, but the scraper bar 40 is moved within the slots 72 away from the outer peripheral region 26 of the roller 16 which is designed, for example, to have an untextured outer peripheral region 26 and is secured in this position. If a scraping operation at the outer peripheral region 26 of this roller 16, which is also visible in FIG. 4, is to occur using this type of scraper device 36 or 38, it is possible, by loosening the fasteners that secure a corresponding mounting element 48, 50, to displace the entire scraper bar 40 toward the outer peripheral region 26 until the first scraper member 56 at the top or secured at the top mounting region 54 is positioned with the scraper edge 73 formed thereon lying close to the outer peripheral region of roller 16. Because of the inclined position of the scraper bar 40 relative to roller 16, the scraper edge 73 is closer to the outer peripheral region 26 of roller 16 than the second scraper members 64. This makes it possible to carry out a scraping operation using the first scraper member 56 of the first scraper region 58 in this first operating position, despite the second scraper members 64 of the second scraper region 66 being attached at the second mounting region 60. Because the first scraper member 56 is fundamentally also still displaceable with respect to the first mounting region 54 toward roller 16 or away from it, it is also possible to make a fine adjustment in this region as well in response to wear or due to this movement.

If a ground preparation machine 10 of this type is to be used to compact soil, for example, whereupon it is advantageous to equip a roller 16 with padfeet 28, the roller 16 may be provided, for example, with a suitable sheathing so that there is texturing created by the padfeet 28 on its outer peripheral region 26. To be able to also use the scraper devices 36, 38 in this state or for a roller of this type with a textured outer peripheral region 26, the scraper bar 40 may be brought into the installation/removal position shown in FIG. 3. This may be done before or after sheathing the roller 16 with elements that create the texturing on the outer peripheral region 26. The transition into the installation/removal position shown in FIG. 3 can be accomplished by removing one of the fasteners, such as bolts, from each of the two mounting elements 48, 50, and then by swiveling the scraper bar 40 around the other fastener or with the other fastener within the respective slot 72, optionally also moving it away from roller 16. For this purpose, it is also possible to provide at least one lever-like or handle-like actuating mechanism 77 on the scraper bar 40 which enables a defined movement into the installation/removal position or out of this position as well as, if required, holding the scraper bar 40 in position. The actuating mechanism 77 may be secured to the scraper bar 40, for example, by welding, but may also be detachably attached to the scraper bar 40 by insertion in a sleeve 79 secured to the scraper bar 40.

Figure 3:
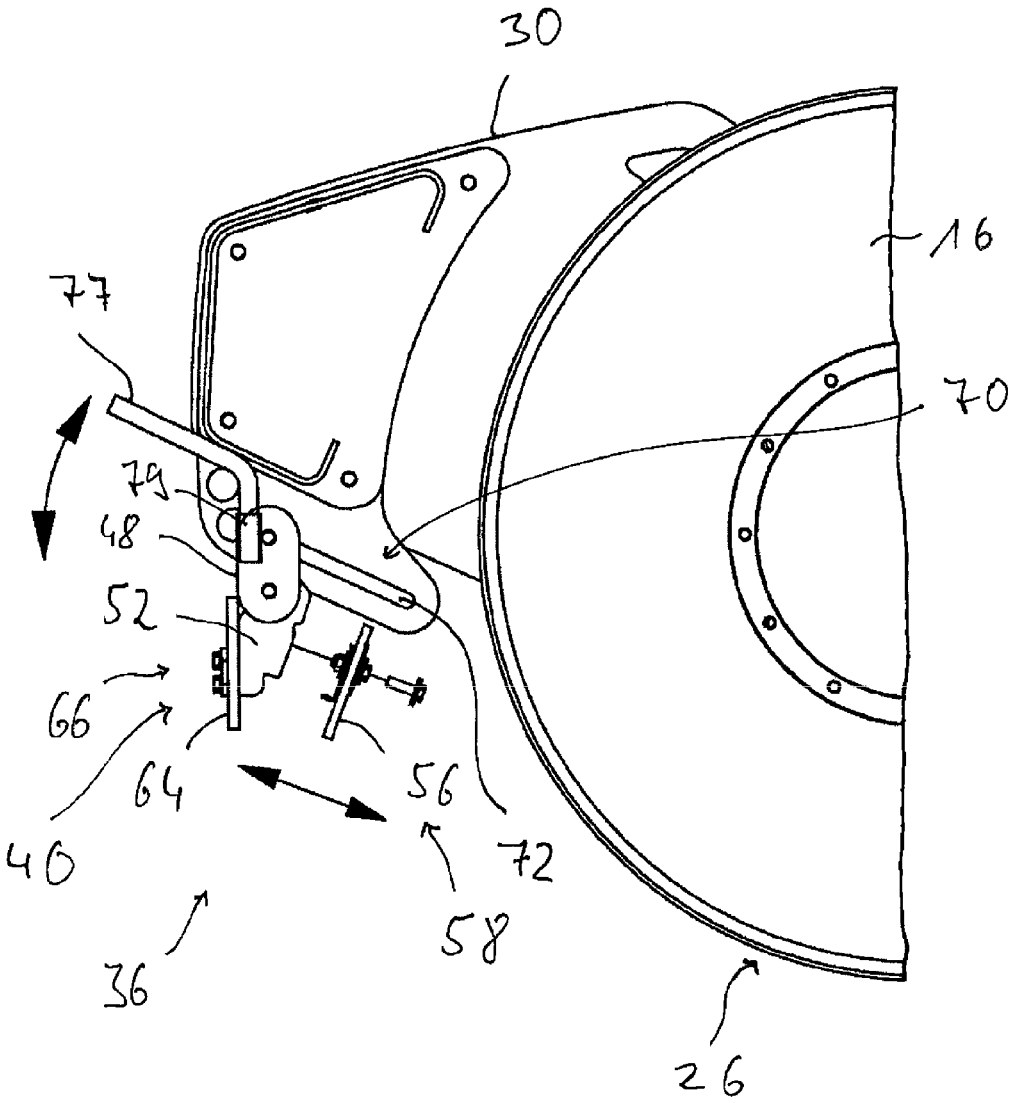
FIG. 3 shows a detail view of a roller having an untextured outer peripheral region and a scraper bar of a scraper device positioned in an installation/removal position.

If the scraper bar is in the position shown in FIG. 3, the first scraper member 56 may be released with the bolt that locks the first mounting region 54, and the entire first scraper member 56 may be removed from the scraper bar 40. It should be noted here that it is possible to assign to the plate-like or blade-like first scraper member 56 on both sides thereof respective intermediate position elements 78, 80 by means of which the first scraper member 56, on the one hand, can brace against the scraper member supports 52 and against which, on the other hand, the bolts securing the first scraper member 56 can brace.

After removal of the first scraper member 56 with the components attached thereto, it is then possible for the scraper bar 40 to be swiveled and displaced from the installation/removal position shown in FIG. 3 back toward the outer peripheral region of roller 16. Because the first scraper member 56 is no longer carried on the scraper bar 40, the scraper bar 40 can be moved toward the outer peripheral region 26 of roller 16 as shown in FIG. 6 until the tooth-like projecting second scraper members 64 engage in the intermediate spaces between the annular successively arranged padfeet 28. In order to achieve this, the second fastener may be brought back in from the position of FIG. 3 after the scraper bar attached to each mounting element 50 is swiveled back so that the scraper bar is prevented from swiveling. Following this, the scraper bar 40 can be moved toward the outer peripheral region 26 until the second scraper members 64, in a second operating position, engage in the intermediate spaces between the rings of padfeet 28 in scraping interaction with roller 16.

It should be noted here that in the first operating position and in the second operating position, the scraper bar 40 may be positioned differently with respect to machine frame 30 or with respect to roller axis of rotation A, for example, having a greater distance from roller axis of rotation A in the first operating position than in the second operating position. However, in principal, the scraper bar 40 could be identically positioned in the two operating positions with respect to machine frame 30 and thus also with respect to the axis of rotation A of the roller, so that the two operating positions are basically differentiated according to which of the scraper members are provided on the scraper bar 40 or are brought into scraping interaction with the roller 12.

It is evident that, because of the wedge-shaped design of the scraper member support 52, the first scraper member 56, on the one hand, and the second scraper members 64, on the other hand, are oriented at different angles of inclination but have the same direction of inclination with respect to roller 16 when, by corresponding positioning on or with scraper bar 40, they are in scraping interaction with roller 16. Therefore, the plate-like first scraper member 56, for example, in the first operating position, that is, when it or the first scraper region 58 is in scraping interaction with roller 16, is oriented at an angle of incidence of about 30° with respect to the outer peripheral region of roller 16. When positioned in the second operating position, that is, when the second scraper members 64 are positioned to engage between the rings of padfeet 28, they have an angle of incidence of approximately 47° with respect to roller 16 or with respect to a line running tangential to it. This angle of inclination for the two scraper regions 58, 66 can be specified for the respective scraper operation to be carried out, on the one hand, by means of the design of the wedge shape of the scraper member support 52 and, on the other hand, by the selection of the angle of inclination of the slots 72.

With the embodiment of the type shown in FIG. 2, the scraper members 56 and 64 of the two scraper regions 58 and 66 are oriented in such a way with respect to a radial line L originating from the axis of rotation A of the roller that, when the ground preparation machine 10 is moving forward, they are inclined in the rotational direction R with a rotational direction R of roller 16. This means that the respective scraper members 56 and 64, when they are extended from the scraper bar 40 toward the outer peripheral region 26 of roller 16, have an extension direction component in the direction of rotational direction R or tangential to it. In the case of the scraper device 40 shown at the lower right in FIG. 2, the scraper members of the two scraper regions 58, 66 are inclined counter to the rotational direction R of roller 16 when the ground preparation machine 10 is moving in the forward driving direction V. This means these scraper members have an extension direction component counter to the rotational direction R based on the scraper bar.

If a conversion is to occur in the reverse order, that is, first working with a roller 16 having a textured outer peripheral region 26, then working with a roller 16 having an untextured outer peripheral region 26, the process described above can be carried out in the reverse sequence. The scraper bar 40 can be brought into its installation/removal position shown in FIG. 3. Thereafter, the first scraper member 56 can be reattached to the scraper bar 40. After this, the scraper bar 40 is brought back into its first operating position and locked in by swiveling or displacing it back, as indicated in FIG. 4. In this process the second scraper members 64 need not be removed.

It should be noted that the embodiment of the scraper devices or of the scraper bar 40 described above may be varied in different ways. For example, the first scraper region 58 could thus be configured with a plurality of plate-like first scraper members 56 that, connecting directly to each other, provide a scraper edge 73 running essentially without interruption along the roller 16. The design and/or dimensioning of the second scraper members 64 can be adapted to the structure of the outer peripheral region 26.

FIGS. 8 to 11 show an alternative type of embodiment of a ground preparation machine. Components or assemblies that correspond in terms of structure or function to previously described components or assemblies are designated with the same reference numbers with the addition of an appended "a".

In the embodiments of the ground preparation machine 10*a* shown in FIGS. 8 to 11, the scraper device 36*a* comprises a scraper bar 40*a* extending essentially parallel to the rotational axis of roller 16*a* and having an essentially triangular cross-sectional profile. The scraper bar 40*a*, or the bar body 42*a* thereof, is constructed with three mounting plates 90*a*, 92*a*, 94*a* arranged in a triangular configuration with respect to each other and can be solidly attached by welding to the mounting elements 48*a*, 50*a* at their longitudinal end regions. The scraper bar 40*a* can be displaced with respect to the machine frame 30*a* in the direction of the slots 72*a* via the mounting elements 48*a*, 50*a* in the manner described above by interaction with the slots 72*a*, can be fixed with respect to machine frame 30*a* or can be swiveled with respect to the machine frame 30*a* for movement into or out of the installation/removal position.

The mounting plate 90*a* provides the first mounting region 54*a* on which a first scraper member 56*a* of the first scraper region 58*a* of plate-like or blade-like design may be attached by means of a plate-like support element 96*a*. The first scraper member 56*a* is secured by bolting it to the plate-like support element 96*a*, which in turn can be secured by bolting it to the mounting plate 90*a*. In the first scraper member 56*a* of plate-like or blade-like design, slots are provided that accommodate bolts used to secure it, so that it may be displaced with respect to the plate-like support element 96*a* away from or toward the scraper bar 40*a* and may be secured in various positions. Moreover, a diverter element 98*a* constructed of sheet metal, for example, is secured together with the first scraper member 56*a* to the plate-like support element 96*a*, using the bolt that also secures the first scraper member 56*a* to it, for example. The diverter element 98*a* extends from the attachment to the plate-like support element 96*a* away from roller 16*a* and covers the scraper bar 40*a*. This ensures that material detached from the outer peripheral region 26*a* of roller 16*a* by the first scraper member 56*a* does not accumulate in the region of the scraper bar 40*a*, but instead is carried away and can fall to the ground.

Figure 8:
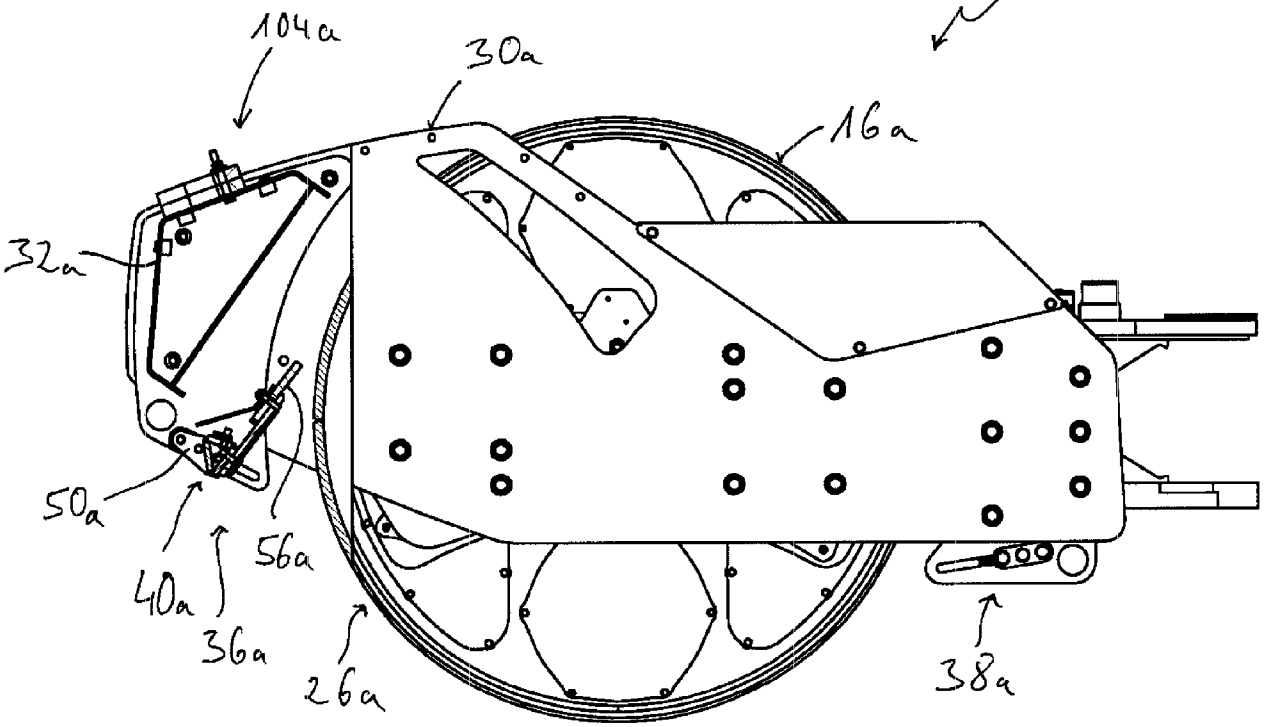
FIG. 8 shows a side view of a part of a ground preparation machine having an alternatively constructed scraper device.
Figure 9:
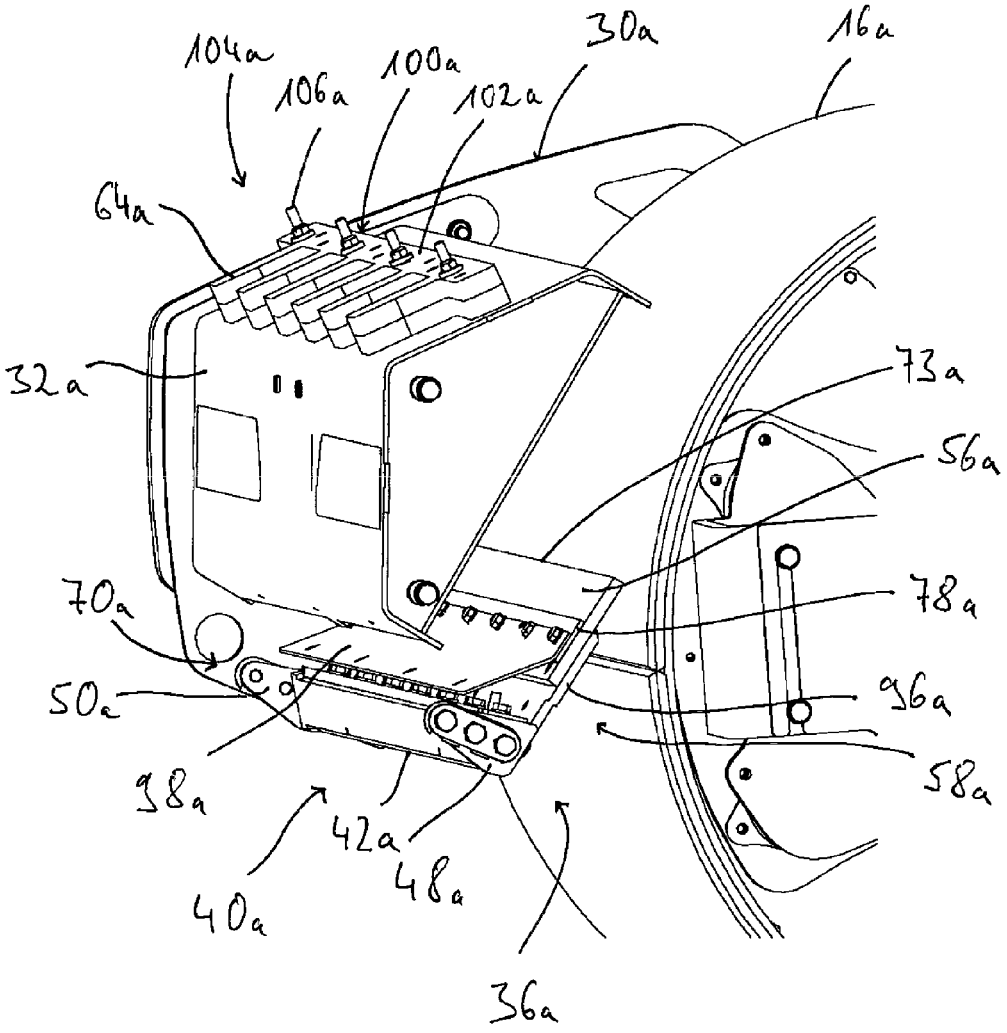
FIG. 9 shows a perspective partial view of the part of a ground preparation machine shown in FIG. 8.

It is clear from FIGS. 8 to 10 that the first scraper member 56*a*, together with the plate-like support element 96*a* that supports it, is angled with respect to radial line L, and specifically that there is an inclination counter to the rotational direction R of roller 16 when the latter is moving in the forward driving direction V. This ensures that the material detached from the outer peripheral region 26*a* can reliably be routed over the scraper bar 40*a* and not accumulate in the region between the scraper member 56*a* and the outer peripheral region 26*a* of roller 16*a*.

In FIG. 10, the scraper bar 40*a*, or the first scraper region 58*a* provided on it, is shown in a transitional position in which the scraper bar 40*a* is swiveled, for example, out of the installation/removal position and is secured against swiveling with respect to the slot 72*a*, but is not yet displaced toward the outer peripheral region 26*a* to bring the first scraper region 58*a* into scraping interaction with the roller 16*a* or the outer peripheral region 26*a* while it is in the first operating position. This may be accomplished by displacement along the slots 72*a* at the bottom right in the illustration of FIG. 10 so that the first scraper member 56*a* approaches the outer peripheral region 26*a*. When it reaches the first operating position, the scraper bar 40*a* may be fixed with respect to the machine frame 30 by bolting, as was described above with respect to the first embodiment.

FIG. 11 shows a second scraper region 66*a* interacting with a roller 16*a* having a textured outer peripheral region 26*a*. The mounting plate 92*a* forms the second mounting region 60*a* for the tooth-like projecting second scraper members 64*a*. These [scraper members] may, as is shown in FIG. 9, be provided as integral components on a scraper member component 100*a*. A bar-like section 102*a* of the scraper member component 100*a* may be secured by bolting it to the plate-like mounting element 92*a* or to the second mounting region 60*a*, so that the tooth-like projecting second scraper members 64*a* are angled with respect to radial line L and may be positioned inclined in rotational direction R so as to engage between adjacent padfeet 28*a*. In this context, FIG. 11 also shows a transitional position between the installation/removal position and the second operating position in which transitional position the scraper bar 40*a*, while it is already kept rotationally fixed with respect to the machine frame 30*a*, is not yet displaced toward the outer peripheral region 26*a*. It should also be noted here that the scraper bar 40*a* in the first operating position, that is, when the first scraper member 58*a* is active, and in the second operating position, that is, when the second scraper members 64*a* are active, may basically occupy the same relative positioning with respect to the machine frame 30*a* or with respect to the roller 16*a*, for example, as a function of the wear of the different scraper members or of the design of the roller 16*a*, but can also occupy different positions along the slots 72*a*.

Because in each case only the first scraper member 58*a* or the second scraper members 64*a*, respectively, can be provided on the scraper bar 40*a* in the embodiment shown in FIGS. 8 to 11, a storage mounting area 104*a* is advantageously provided on the machine frame 30*a*. This [storage mounting area] may be formed on the cross-member 32*a* of the machine frame 30 and may include a plurality of bolts 106*a* on the cross-member 32*a* to secure one or a plurality of first scraper members 56*a* together with a respective plate-like support 96*a* and one or a plurality of diverter elements 98*a*. If the first scraper members 56*a* in FIG. 11 provided on the storage mounting area 104*a* or one of them is used, they can be exchanged for the scraper member components 100*a* or secured to the scraper bar 40*a*. In this case, the scraper member components 100*a* can then be attached to the storage mounting area 104*a* using the bolts 106*a*.

It is clear in each of FIGS. 8 to 11 that two first scraper members 56*a* along with the attached plate-like supports 96*a* and/or diverter elements 98*a* or two scraper member components 100*a*, each providing a plurality of second scraper members 64*a*, can be provided on the storage mounting area 104*a*. In this connection, in each case one of these assemblies can serve as a reserve in the event that the other is worn or damaged. In principle, the embodiment could also be of the type that, to cover the entire extension length of the roller 16*a* in the direction of the roller axis of rotation, a plurality of first scraper members 56*a* along with the attached plate-like supports 96*a* and diverter elements 98*a* are attached in succession to the plate-like mounting element 90*a* or, accordingly, a plurality of scraper member components 100*a* are also attached to the plate-like mounting element 92*a*. The design of these assemblies shorter in length than the roller 16*a* simplifies handling when they are installed on the scraper bar 40*a* or removed from the scraper bar 40*a*.

Basically, it should be noted that a scraper device or scraper bar designed according to the invention can also be used as basic equipment in a ground preparation machine that is not intended for switching between different states of the roller. Therefore, depending on the type of use, the first scraper member can be completely removed or the second scraper members can be removed if there is absolutely no need for them. Nevertheless, one and the same scraper bar in its basic configuration can be used for ground preparation machines of almost any configuration. It should also be noted that the texturing on the outer peripheral region of a roller does not necessarily have to be composed of padfeet. Other elements that result in texturing, such as cutters or other ground preparation tools, could also be provided on the outer periphery of such a roller.

The invention claimed is:

1. A ground preparation machine, in particular a compactor, comprising:

at least one roller rotatable around an axis of rotation of a roller, attached to at least one roller, at least one scraper device for scraping off material adhering to the outer peripheral region of the roller, wherein the scraper device comprises a scraper bar extending along the roller, the scraper bar being designed to provide a first scraper region for scraping material from a roller having an essentially untextured outer peripheral region and being designed to provide a second scraper region for scraping material from a roller having a textured outer peripheral region, and further wherein scraper bar is movable among:

a first operating position, wherein, in the first operating position, the first scraper region is in scraping interaction with the roller, a second operating position different from the first operating position, wherein, in the second operating position, the second scraper region is in scraping interaction with the roller, and an installation/removal position, wherein, in the installation/removal position, the scraper bar is positioned for installation/removal and/or for adjustment of at least one first scraper member of the first scraper region and/or of at least one second scraper member of the second scraper region.

2. The ground preparation machine according to claim 1, wherein the scraper bar preferably extends along the roller essentially parallel to the axis of rotation of the roller.

3. The ground preparation machine according to claim 1, wherein the scraper bar is capable of being swiveled around an axis of movement essentially parallel to the axis of rotation of the roller and/or is displaceable toward the outer peripheral region of the roller and away from the outer peripheral region of the roller.

4. The ground preparation machine according to claim 3, wherein the scraper bar is solidly attachable at its two end regions to a machine frame in the first operating position and/or in the second operating position and is swivelably mounted on the machine frame for movement into and out of the installation/removal position.

5. The ground preparation machine according to claim 4, wherein a slot guide is provided that is attached to each end region of the scraper bar on the machine frame, the scraper bar being solidly attached or attachable to the machine frame via at least one fastener, preferably a plurality of fasteners, passing through the slot guide in the first and/or in the second operating position and being swivelable with respect to the machine frame via a fastener passing through the slot guide.

6. The ground preparation machine according to claim 1, wherein the scraper bar comprises a first mounting region for the attachment of at least one first scraper member of the first scraper region and a second mounting region for the attachment of at least one second scraper member of the second scraper region.

7. The ground preparation machine according to claim 6, wherein the scraper bar comprises a longitudinally extending bar body and a plurality of scraper member supports on the bar body essentially providing the first mounting region and the second mounting region.

8. The ground preparation machine according to claim 6, wherein the scraper bar comprises a longitudinally extending bar body having at least one first mounting plate providing the first mounting region and at least one second mounting plate providing the second mounting region.

9. The ground preparation machine according to claim 1, wherein the first scraper region comprises at least one first scraper member providing a scraper edge running essentially without interruption along the roller axis of rotation, and/or in that the second scraper region comprises a plurality of tooth-like projecting second scraper members arranged spaced apart from each other along the axis of rotation of the roller.

10. The ground preparation machine according to claim 1, wherein, when a scraper bar is positioned in the first operating position, the at least one scraper member of the first scraper region is in scraping interaction with the outer peripheral region of the roller and the second scraper members of the second scraper region are not in scraping interaction with the outer peripheral region of the roller and that, when the scraper bar is positioned in the second operating position, the at least one first scraper member of the first scraper region is removed from the scraper bar and the second scraper members of the second scraper region are in scraping interaction with the outer peripheral region of the roller.

11. The ground preparation machine according to claim 1, wherein at least one actuating mechanism for swiveling and/or displacing and/or holding the scraper bar is attached or attachable to the scraper bar.

12. The ground preparation machine according to claim 1, wherein at least one scraper region comprises at least one scraper member that can be brought into scraping interaction with the roller, wherein at least one, preferably each, scraper member of at least one scraper region is angled with respect to a radial line perpendicular to the roller axis of rotation and is inclined in the rotational direction of the roller, and/or at least one, preferably each, scraper member of at least one scraper region is angled relative to the radial line and is inclined counter to the rotational direction of the roller.

13. The ground preparation machine according to claim 12, wherein at least one scraper member of the first scraper region and at least one scraper member of the second scraper region are inclined in the same direction, preferably in the rotational direction of the roller.

14. The ground preparation machine according to claim 12, wherein at least one scraper member of the first scraper region is inclined in a first direction, preferably counter to the rotational direction, and at least one scraper member of the second scraper region is inclined in a second direction, preferably in the rotational direction.

15. The ground preparation machine according to claim 12, wherein a diverter device for diverting material detached from the roller by the scraper member away from the roller is attached to at least one scraper member that is preferably inclined counter to the rotational direction of the roller.

16. The ground preparation machine according to claim 1, wherein at least one storage mounting area is provided for detachably mounting at least one scraper member not installed on the scraper bar, preferably on a machine frame rotatably carrying the roller.

17. A method for operating a ground preparation machine, the ground preparation machine including at least one roller rotatable around an axis of rotation of a roller, attached to at least one roller, at least one scraper device for scraping off material adhering to the outer peripheral region of the roller, wherein the scraper device includes a scraper bar extending along the roller, the scraper bar being designed to provide a first scraper region for scraping material from a roller having an essentially untextured outer peripheral region and being designed to provide a second scraper region for scraping material from a roller having a textured outer peripheral region, in which method, if the ground preparation machine is operated using a roller having an essentially untextured outer peripheral region, at least one scraper device attached to this roller is configured in such a way and positioned in a first operating position so that the scraper bar with its first scraper region is in scraping interaction with the outer peripheral region of the roller and, if the ground preparation machine is operated using a roller having a textured outer peripheral region, at least one scraper device attached to this roller is configured in such a way and positioned in a second operating position different from the first operating position so that the scraper bar with its second scraper region is in scraping interaction with the outer peripheral region of the roller.

18. The method according to claim 17, wherein, for operation with a roller having a textured outer peripheral region, at least one first scraper member of the first scraper region is removed from the scraper bar when the scraper bar is positioned in the installation/removal position, and the scraper bar is subsequently positioned in its second operating position via a swiveling and/or displacement movement.

* * * * *